US011332306B2

(12) United States Patent
Godby

(10) Patent No.: US 11,332,306 B2
(45) Date of Patent: May 17, 2022

(54) LAWN BAG AND ACCESSORY

(71) Applicant: Jordan W. Godby, Fort Worth, TX (US)

(72) Inventor: Jordan W. Godby, Fort Worth, TX (US)

( * ) Notice: Subject to any disclaimer, the term of this patent is extended or adjusted under 35 U.S.C. 154(b) by 0 days.

(21) Appl. No.: 16/824,974

(22) Filed: Mar. 20, 2020

(65) Prior Publication Data

US 2021/0292084 A1 Sep. 23, 2021

(51) Int. Cl.
*B65F 1/00* (2006.01)
*B65F 1/14* (2006.01)

(52) U.S. Cl.
CPC ..... *B65F 1/0006* (2013.01); *B65F 1/1415* (2013.01); *B65F 2240/138* (2013.01)

(58) Field of Classification Search
CPC . B65F 1/0006; B65F 1/1415; B65F 2240/138
USPC ..... 383/105
See application file for complete search history.

(56) References Cited

U.S. PATENT DOCUMENTS 2,833,460 A * 5/1958 Votolato ..... B65F 1/06 383/36
3,062,428 A * 11/1962 Oettinger ..... B65D 5/2052 229/198.3
3,426,958 A * 2/1969 Gore ..... B65D 33/14 383/11
3,747,653 A 7/1973 Ringer
3,998,415 A 12/1976 D'Antonio
4,530,533 A * 7/1985 Dieter ..... B65B 67/1238 294/1.3
4,664,348 A * 5/1987 Corsaut, III ..... B65B 67/1238 141/108
4,832,291 A * 5/1989 Nelson ..... B65B 67/1238 D34/5
5,009,378 A * 4/1991 Linsmeyer ..... B65B 67/12 248/99
5,011,103 A 4/1991 Hayes
5,031,277 A * 7/1991 Coker ..... A47L 11/4013 15/257.3
5,031,948 A 7/1991 Groth
5,065,965 A * 11/1991 Aulabaugh ..... B65B 67/1255 248/99
5,149,028 A 9/1992 Blackaby
5,183,339 A 2/1993 Williams
5,271,589 A 12/1993 Belous
5,323,990 A 6/1994 Graves
5,655,739 A * 8/1997 Teh-Wah Goo .... B65B 67/1233 141/390
6,491,264 B1 12/2002 Valesquez
6,585,304 B1 7/2003 Boozer
6,708,742 B2 3/2004 Weathers
(Continued)

*Primary Examiner* — Peter N Helvey
(74) *Attorney, Agent, or Firm* — Brian K. Yost; Decker Jones, PC

(57) ABSTRACT

The lawn bag generally comprises a bag bottom, bag sides, and left-side and right-side flaps, each foldingly connected to one of the bag sides. The left-side and right-side flaps are each moveable from stowed positions to extended positions. The flaps in the stowed position may be positioned flat against the respective sides to which they are attached. The left-side flap and the right-side flap, when in the extended position, extends to the left and right of the bag, respectively, and are generally coplanar with a bag front side.

7 Claims, 5 Drawing Sheets

(56) References Cited

U.S. PATENT DOCUMENTS

| | | | | |
|---|---|---|---|---|
| 7,302,978 | B1 * | 12/2007 | Kolarik | B65B 67/1205 141/391 |
| 7,736,057 | B2 * | 6/2010 | VanBost | B65F 1/10 383/33 |
| 7,744,044 | B2 * | 6/2010 | Gabriel | B65B 67/12 248/101 |
| 8,517,610 | B2 * | 8/2013 | Arcot | B65D 33/00 383/104 |
| 9,409,666 | B1 | 8/2016 | Staten | |
| 10,112,734 | B1 * | 10/2018 | Schrager | B65B 67/04 |
| 2002/0100844 | A1 | 8/2002 | Green | |
| 2004/0026578 | A1 * | 2/2004 | King | B65F 1/1415 248/95 |
| 2006/0144467 | A1 * | 7/2006 | Butzer | B65B 67/04 141/391 |
| 2008/0044111 | A1 | 2/2008 | Faraone | |
| 2011/0147545 | A1 | 6/2011 | Faraone | |
| 2012/0248118 | A1 * | 10/2012 | Perkowski | A01G 20/43 220/495.08 |
| 2015/0360861 | A1 | 12/2015 | Vincent | |

* cited by examiner

LAWN BAG AND ACCESSORY

BACKGROUND OF THE INVENTION

1. Field of the Invention

The present invention relates generally to refuse receptacles and specifically to a lawn bag and an accessory for a lawn bag.

2. Description of the Prior Art

Landscape maintenance may involve, among other things, mowing grass, pulling weeds, trimming bushes, and raking leaves. These activities, though enjoyable, can be time consuming and somewhat strenuous. One of the last tasks needing to take place after caring for an outdoor area is clean up. Grass clippings, weeds, and leaves, for example may need to be collected and moved off site. Typically, plastic or paper lawn bags are used for this. Debris is swept into piles and, using either one's hands, a rake, or a shovel, moved into the bag. However, this simple activity can become frustrating because the bag tends to move upon insertion of the debris and because the bag opening does not always remain open.

Numerous attempts have been made in an effort to address these issues. For example, U.S. Pat. No. 3,747,653, Ringer teaches a bag attachment with an outer hoop and lifting handle. U.S. Pat. No. 3,998,415, D'Antonio discloses a bag attachment with hoop and spreader bar. U.S. Pat. Pub. No. 20020100844, Green discloses a bag having a front "ramp" and stake attachment members. U.S. Pat. No. 5,031,948, Groth discloses a bag having a front "ramp" with sides and lifting handle. U.S. Pat. No. 5,149,028, Blackaby and U.S. Pat. No. 5,183,339, Williams each disclose a hoop attachment for a bag. U.S. Pat. No. 5,271,589, Belous teaches an upright container assembly comprising a funnel top portion with sides. U.S. Pat. No. 6,708,742, Weathers teaches a popcorn scoop-like funnel attachment for a bag. U.S. Pat. No. 6,491,264, Valesquez discloses an upright frame for a bag. U.S. Pat. No. 5,323,990, Graves discloses a rigid ramp assembly. U.S. Pat. No. 9,409,666, Staten discloses a bag with extension portions secured by pins or stakes. U.S. Pat. No. 5,011,103, Hayes discloses a bag with a hoop and outside tie straps. U.S. Pat. Pub. No. 20050011997, Kalal teaches a bag and hoop with a forward flap. U.S. Pat. Pub. No. 20080044111, Faraone teaches a bag with forward flap and upper handle. U.S. Pat. Pub. No. 20110147545, Faraone teaches a handle attachment wherein the bag is coupled through slits in a spreader bar. U.S. Pat. Pub. No. 20150360861, Vincent comprises a removeably coupled side closure which permits the bag to be spread open.

Although there are several prior art bags and bag attachments that purport to address the problem of maintaining the shape of a bag and keeping the bag from moving while inserting lawn debris, the solutions are generally expensive, cumbersome, and overly complicated. What is needed is a lawn bag that is inexpensive, easy to set up, and simple to use.

SUMMARY OF THE INVENTION

A lawn bag for use with lawn debris is provided. The lawn bag generally comprises a bag bottom, bag sides, and left-side and right-side flaps. The bag sides comprise a bag front side, bag rear side, a bag left side, and a bag right side. The bag bottom is connected to the bag sides. The bag bottom and bag sides define a receptacle comprising a top opening. The left-side flap is foldingly connected to one of the bag sides. In preferred embodiments, the left-side flap is connected to either the bag left side or the bag front side. The right-side flap is also foldingly connected to one of the bag sides. Each of the right-side and left-side flaps of the preferred embodiment are bendable. In preferred embodiments, the right-side flap is connected to either the right side or the bag front side. As they are both foldingly connected, the left-side and right-side flaps are each moveable from stowed positions to extended positions. In certain embodiments, the flaps in the stowed position are positioned flat against the respective sides to which they are attached. For example, the right-side flap stowed position may be such that the right-side flap is positioned against either the bag right side or the bag front side. Similarly, the left-side flap stowed position may be such that the left-side flap is positioned against either the bag left side or the bag front side. In other embodiments, the left-side and right-side flaps may be foldingly connected to the bag left side and right side, respectively, but rest primarily against the bag front side when in the stowed position. In other embodiments, the left-side and right-side flaps are foldingly coupled to a corner of the bag, such as, for example, the corner at which the bag left side and bag front side meet.

The left-side flap of the preferred embodiment is positioned proximate to upper portions of the bag front side and bag left side such that, when in the extended position, the left-side flap extends to the left of the bag left side and is generally coplanar with the bag front side. Similarly, the right-side flap is positioned proximate to the bag front side and bag right side such that, when in the extended position, the right-side flap extends to the right of the bag right side and is generally coplanar with the bag front side.

In other embodiments, the bag comprises an integrated flap. The left-side flap and the right-side flap of these embodiments are foldingly connected to a central flap.

The integrated flap is structured and arranged such that, when in a downward stowed position, the integrated flap is positioned immediately adjacent to outside portions of the bag left, bag right, and bag front sides such that the left-side flap is coplanar with the bag left side, the right-side flap is co-planar with the bag right side, and the central flap is coplanar with the bag front side.

When the left-side flap and right-side flap are extended forward, the left-side flap and right-side flap are co-planar with the bag front side. Alternatively, the central flap, together with left-side and right-side flaps are adapted to be moved upward. In such position, the integrated flap extends upward from a top front edge of the lawn bag.

In use, the lawn bag is positioned such that the bag front side, the left-side flap and right-side flap are generally co-planar with a working surface such as the ground. In such position, a user may position himself/herself with each foot on the respective left-side flap and right-side flap. In this position, the user, using his/her hands, a rake, or other garden implement, can then pull garden debris such as leaves, grass clippings, weeds, bush clippings, and the like, through the opening into the leaf bag. This activity can be performed with the central flap positioned against the bag front side or with the central flap extended forward.

In preferred embodiments, the lawn bag is formed from heavy duty two-ply biodegradable paper. In such embodiments, each side comprises a thickness of approximately 0.198 mms. However, the lawn bag need not be formed from paper. Rather, the lawn bag can be formed from other suitable materials such as Polypropylene (PP), high-density polyethylene (HDPE), low-density polyethylene (LDPE), or linear low-density polyethylene (LLDPE) and the like and may be formed from oxo-degradable or UV degradable materials and/or biobased, biodegradable and compostable materials such as polylactic acid (PLA) and polyglycolic acid (PGA).

In other embodiments, the lawn bag may comprise a drawstring.

In another aspect of the present invention, a refuse bag accessory adapted to be removeably coupled to a conventional refuse bag is presented. The refuse bag accessory comprises an elongated bar, clips, and footholds. In the preferred embodiments, the refuse bag accessory is adapted to be coupled to a top portion of a front refuse bag side of a conventional refuse bag. The refuse bag accessory of the preferred embodiment is composed of acrylonitrile butadiene styrene (ABS) and has a generally flat configuration such that when positioned on the refuse bag as described herein, it is generally coplanar with the front refuse bag side. However, other suitable materials known in the art may be used.

DESCRIPTION OF THE PREFERRED EMBODIMENT

Figure 1:
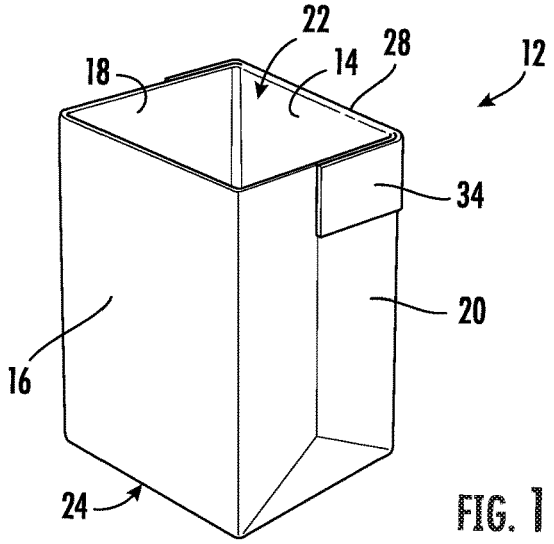
FIG. 1 is a top, rear, and left side view of the lawn bag, in accordance with a preferred embodiment.

Referring to FIGS. 1-10, there is shown the lawn bag 12 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

Referring to FIGS. 6-10, the lawn bag 12 of the preferred embodiment generally comprises a bag bottom 24, bag sides 14, 16, 18, 20, and left-side and right-side flaps 32,34. The bag sides comprise a bag front side 14, bag rear side 16, a bag left side 18, and a bag right side 20. The bag bottom 24 is connected to the bag sides 14, 16, 18, 20. The bag bottom 24 and bag sides 14, 16, 18, 20 define a receptacle comprising a top opening 22. The left-side flap 32 is foldingly connected to one of the bag sides 14, 16, 18, 20. In preferred embodiments, the left-side flap 32 is connected to either the bag left side 18 or the bag front side 14. The right-side flap 34 is also foldingly connected to one of the bag sides 14, 16, 18, 20. Each of the right-side and left-side flaps 34, 32 of the preferred embodiment is bendable. In preferred embodiments, the right-side flap 34 is connected to either the right side 20 or the bag front side 14. As they are both foldingly connected, the left-side and right-side flaps 32, 34 are each moveable from stowed positions to extended positions. In certain embodiments, the left-side and right-side flaps 32, 34 are positioned flat against the respective sides 14, 16, 18, 20 to which they are attached. For example, the right-side flap 34 stowed position may be such that the right-side flap 34 is positioned against either the bag right side 20 or the bag front side 14. Similarly, the left-side flap 32 stowed position may be such that the left-side flap 32 is positioned against either the bag left side 18 or the bag front side 14. Although in certain embodiments the right-side and left-side flap 32, 34 stowed position is such that the respective right-side and left-side flaps 32, 34 are positioned flat against the side 14, 16, 18, 20 to which the respective right-side and left-side flaps 32, 34 are attached, the right-side and left-side flap 32, 34 stowed position need not be such. In other embodiments, for example, the left-side flap 32 may be foldingly connected to the bag left side 18 but rest primarily against the bag front side 14 when in the stowed position. In other embodiments, the left-side and right-side flaps 32, 34 are foldingly coupled to a corner of the lawn bag 12, such as, for example, the corner at which the bag left side 18 and bag front side 14 meet.

The left-side flap 32 of the preferred embodiment is positioned proximate to upper portions of the bag front side 14 and bag left side 18 such that, when in the extended position, the left-side flap 32 extends to the left of the bag left side 18 and is generally coplanar with the bag front side 14. Similarly, the right-side flap 34 is positioned proximate to the bag front side 14 and bag right side 20 such that, when in the extended position, the right-side flap 34 extends to the right of the bag right side 20 and is generally coplanar with the bag front side 14.

Referring to FIGS. 1-5, in other embodiments, the lawn bag comprises the bag front 14, bag rear 16, bag left side 18, bag right side 20, bag bottom 24, and an integrated flap 36. The bag front 14, bag rear 16, bag left side 18, bag right side 20, and bag bottom 24 define a receptacle comprising a top opening 22. The integrated flap 36 of such embodiments comprises the left-side flap 32, right-side flap 34 and a central flap 26. The central flap in these embodiments is foldingly connected to the bag front side. The left-side and right-side flaps 32,34 of these embodiments are foldingly connected to the central flap. The central flap 26, left-side flap 32 and right-side flap 34 are each moveable from stowed positions to respective extended positions. As with other embodiments, the left-side flap 32, when in the extended position, extends to the left of the bag left side 18 and is generally coplanar with the bag front side 14. The right-side flap 34, when in the extended position, extends to the right of the bag right side 20 and is generally coplanar with the bag front side 14. The central flap 26, when in the extended position, extends from, and is generally coplanar with, the bag front side 14.

The integrated flap 36 is structured and arranged such that when in a downward stowed position as shown in FIG. 1, the integrated flap 36 is positioned immediately adjacent to outside portions of the bag left 18, bag right 20, and bag front 14 sides such that the left-side flap 32 is coplanar with the bag left side 18, the right-side flap 34 is co-planar with the bag right side 20, and the central flap 26 is coplanar with the bag front side 14.

Figure 2:
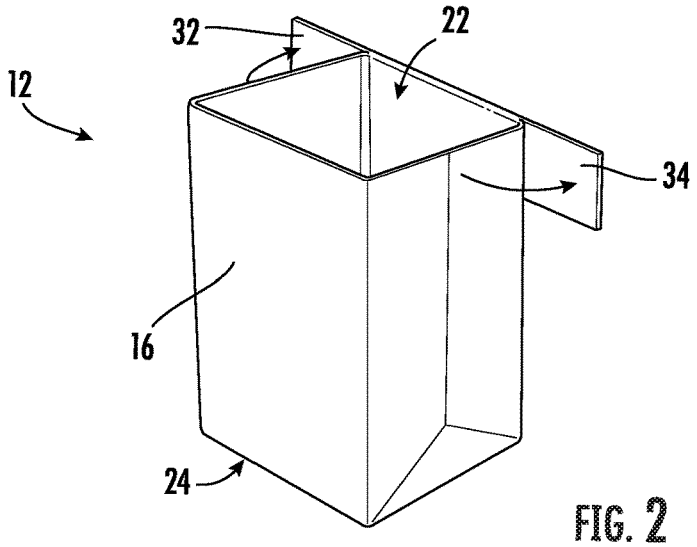
FIG. 2 is a top, rear, and left side view of the lawn bag of FIG. 1, with the left-side and right-side flaps extended forward and the central flap portion in the downward, stowed position.
Figure 3:
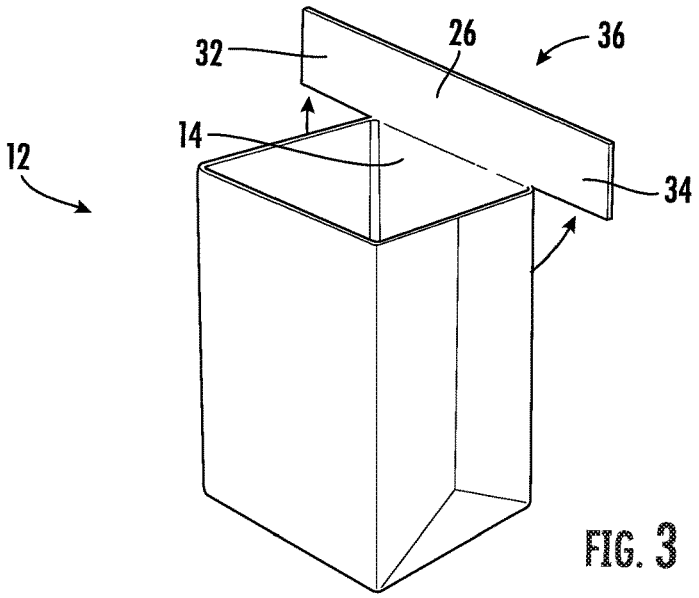
FIG. 3 is a top, rear, and left side view of the lawn bag of FIG. 1, with the left-side, right-side, and central flaps in the upward position.

When the left-side flap 32 and right-side flap 34 are extended forward, as shown, for example, in FIG. 2, the left-side flap 32 and right-side flap 34 are co-planar with the bag front side 14. In this position, the lawn bag 12 can be used as will be described in more detail below. Alternatively, the central flap 26, together with left-side and right-side flaps 32, 34, are adapted to be moved upward from the position shown in FIG. 2 to the position depicted in FIG. 3. In such position, the integrated flap 36 extends upward from a top front edge 28 of the lawn bag 12.

In use, the lawn bag 12 is positioned such that the bag front side 14, the left-side flap 32 and right-side flap 34 are generally co-planar with a working surface such as the ground. In such position, a user 4 may position himself/herself with each foot 6,6 on the respective left-side flap 32 and right-side flap 34. In this position, the user 4, using a rake 8 or other garden implement, can then pull garden debris 36 such as leaves, grass clippings, weeds, bush clippings, and the like, through the opening 22 into the leaf bag 12. This activity can be performed with the central flap 26 positioned against the bag front side 16, as shown in FIG. 2, or with the central flap 26 extended forward, as shown, for example, in FIG. 3.

In preferred embodiments, the lawn bag 12 is formed from heavy duty two-ply biodegradable paper. In such embodiments, each side 14, 16, 18, 20 and bottom 24 comprise a thickness of approximately 0.198 mms. However, the lawn bag 12 need not be formed from paper. Rather, the lawn bag 12 can be formed from other suitable materials such as Polypropylene (PP), high-density polyethylene (HDPE), low-density polyethylene (LDPE), or linear low-density polyethylene (LLDPE) and the like and may be formed from oxo-degradable or UV degradable materials and/or biobased, biodegradable and compostable materials such as polylactic acid (PLA) and polyglycolic acid (PGA).

In other embodiments, the lawn bag 12 may comprise a drawstring or band adapted to close the top opening 22. Such drawstring can be attached in a conventional manner such that, for example, the drawstring is threaded through openings in an upper portion of the lawn bag 12. Other closure mechanisms may also be used such as tie extensions. In some embodiments, the left-flap 32 and right-flap 34 may be tied together to close the top opening 22.

Figure 4:
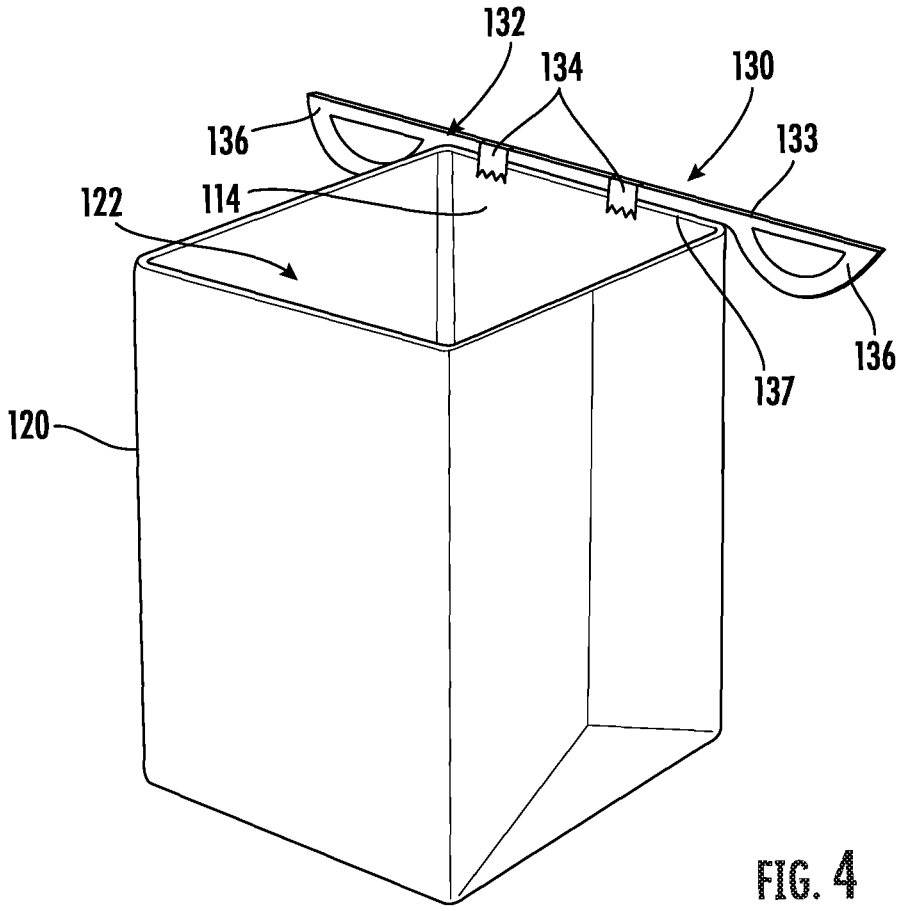
FIG. 4 is a top, rear, and left side view of the lawn bag accessory attached to a bag, in accordance with a preferred embodiment.
Figure 5:
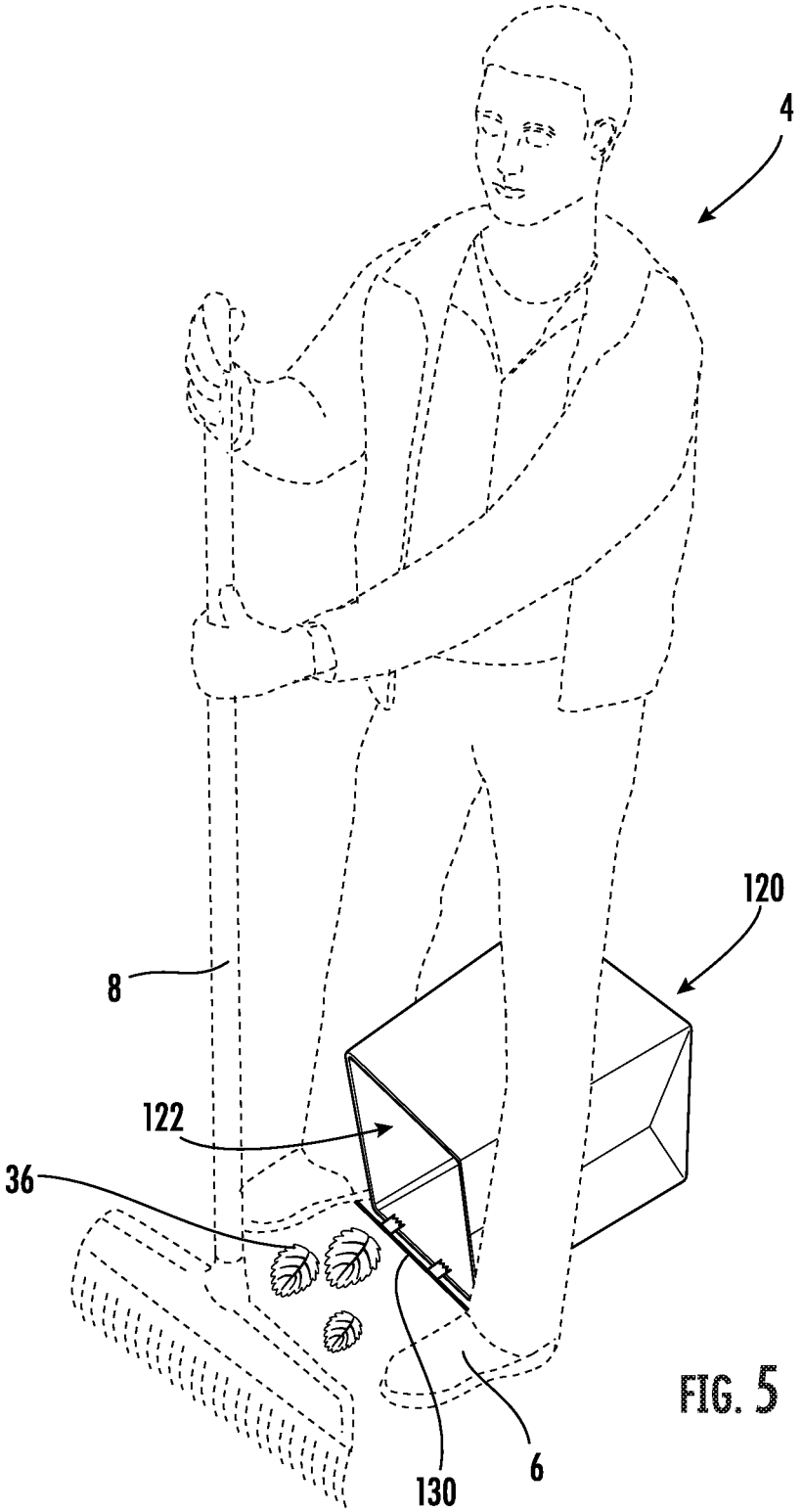
FIG. 5 is a top, rear, and left side view of the lawn bag of FIG. 4, with a user with a rake shown in phantom, the user straddling the bag with the user's feet position on the footholds.
Figure 6:
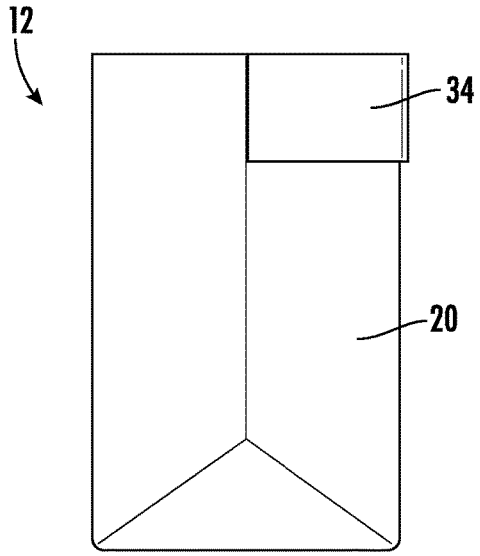
FIG. 6 is a right-side elevation view of the lawn bag with the right-side flap in the stowed position, in accordance with another embodiment.
Figure 7:
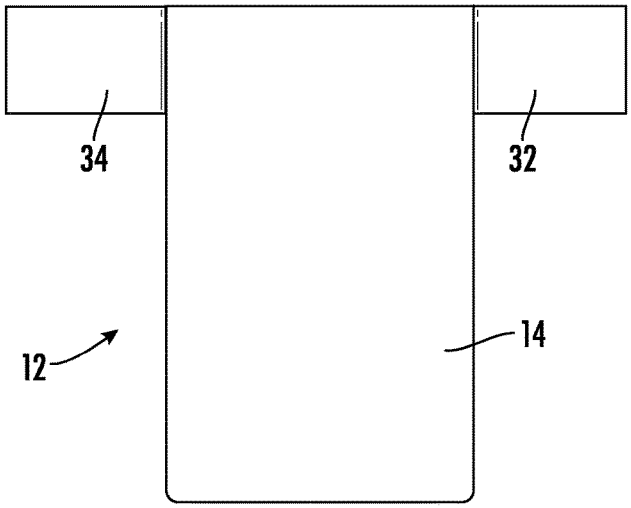
FIG. 7 is a front-side elevation view of the lawn bag of FIG. 6, with the right-side and left-side flaps in the extended positions.
Figure 8:
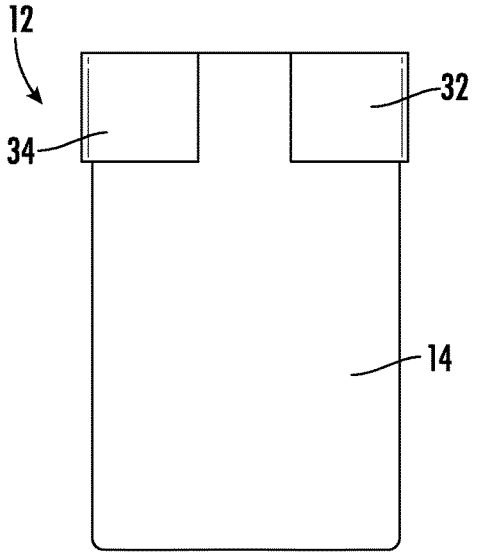
FIG. 8 is a front-side elevation view of the lawn bag with the right-side and left-side flaps in the stowed position, in accordance with another embodiment.
Figure 9:
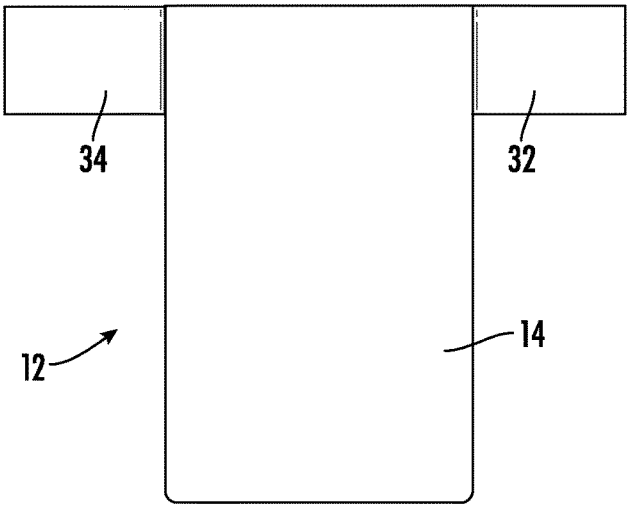
FIG. 9 is a front-side elevation view of the lawn bag of FIG. 8, with the right-side and left-side flaps in the extended positions.
Figure 10:
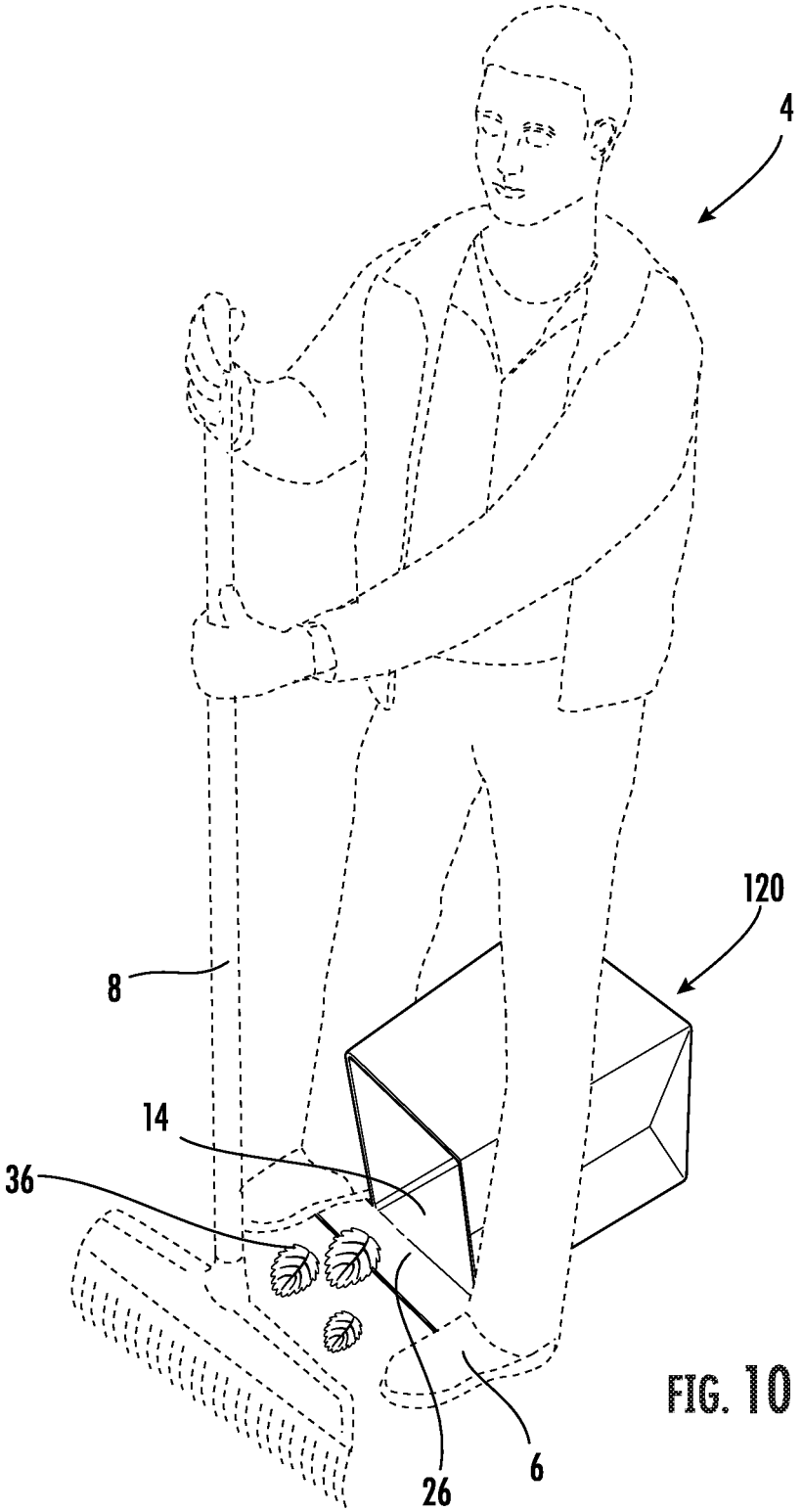
FIG. 10 is a top, rear, and left side view of the lawn bag of FIG. 7, with a user with a rake shown in phantom, the user straddling the bag with the user's feet positioned on the respective right-side and left-side flaps.

Referring to FIG. 4, in another aspect of the present invention, a refuse bag accessory 130 adapted to be removeably coupled to a conventional refuse bag 120 is presented. The refuse bag accessory 130 is adapted to be removeably coupled to a conventional refuse bag 120. The refuse bag accessory 130 comprises an elongated bar 132 comprising one or more clips 134, and first and second footholds 136. The elongated bar 132 comprises a leading edge 133 and has a generally flat configuration. The first and second footholds 136 are positioned at opposite ends of the elongated bar 132. The leading edge 133 extends between the first and second footholds 136 and is arranged generally parallel to a top edge 137 of a front refuse bag side 114. The one or more clips 134 are adapted to removeably couple the elongated bar 132 to the refuse bag 120 such that when the elongated bar 132 is coupled to the refuse bag 120, the footholds 136 extend beyond opposite edges of the refuse bag 120.

The one or more clips 134 are conventional and commercially available clips 134 which are adapted to clamp the refuse bag 120, directly or indirectly, to the elongated bar 132. For example, the one or more clips 134 may be spring loaded and biased in a closed position.

The refuse bag accessory 130 of the preferred embodiment is composed of acrylonitrile butadiene styrene (ABS) and has a generally flat configuration such that when positioned on the refuse bag 120 as described herein, it is generally coplanar with the front refuse bag side 114. As shown, for example, in FIG. 5, in use, the conventional refuse bag 120 is positioned such that the bag front side 114 and the refuse bag accessory 130 are generally co-planar with a working surface such as the ground. In such position, a user 4 may position himself/herself with each foot 6,6 on the respective footholds 136. In this position, the user 4, using a rake 8 or other garden implement, can then pull garden debris 36 such as leaves, grass clippings, weeds, bush clippings, and the like, through an opening 122 into the refuse bag 120.

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure.

I claim:

1. A lawn bag comprising:

a bag bottom, bag sides, and left-side and right-side flaps, the bag bottom being connected to the bag sides;

the bag sides comprising a bag front side, a bag rear side, a bag left side, and a bag right side;

the bag bottom and bag sides defining a receptacle comprising a top opening;

the left-side flap having a left-side flap connection portion and left-side flap perimeter edges;

the right-side flap having a right-side flap connection portion and right-side flap perimeter edges;

the left-side flap connection portion being foldingly connected to one of the bag sides such that the left-side flap pivots about a single left-side flap vertical axis when the bag is in an upright position;

the right-side flap connection portion being foldingly connected to one of the bag sides such that the right-side flap pivots about a single right-side flap vertical axis when the bag is in the upright position;

the left-side and right-side flaps each being moveable from stowed positions to extended positions;

the left-side flap being positioned proximate to upper portions of the bag front side and the bag left side such that, when in the extended position, the left-side flap extends to the left of the bag left side and is coplanar or parallel planar with the bag front side and such that the left-side flap perimeter edges are free; and the right-side flap being positioned proximate to upper portions of the bag front side and bag right side such that, when in the extended position, the right-side flap extends to the right of the bag right side and is coplanar or parallel planar with the bag front side and such that the right-side flap perimeter edges are free.

2. The lawn bag of claim 1, wherein the left-side flap connection portion is foldingly connected to the bag left side.

3. The lawn bag of claim 1, wherein the left-side flap connection portion is foldingly connected to the bag front side.

4. The lawn bag of claim 1, wherein the right-side flap connection portion is foldingly connected to the bag right side.

5. The lawn bag of claim 1, wherein the right-side flap connection portion is foldingly connected to the bag front side.

6. The lawn bag of claim 1, wherein the right-side flap connection portion is connected at a juncture defined by the bag front side and the bag right side.

7. The lawn bag of claim 1, wherein the left-side flap connection portion is connected at a juncture defined by the bag front side and the bag left side.

* * * * *